United States Patent [19]

Falcq

[11] 4,143,594

[45] Mar. 13, 1979

[54] DEVICE FOR BINDING BUNDLES OF ELONGATE ANGLE-SECTION MEMBERS AND MANUFACTURING APPARATUS INCORPORATING SUCH DEVICES

[75] Inventor: René G. Falcq, Chaudfontaine (Embourg), Belgium

[73] Assignee: Société Anonyme Metal Deploye Belge, Sclessin-Ougrée, Belgium

[21] Appl. No.: 854,353

[22] Filed: Nov. 23, 1977.

[30] Foreign Application Priority Data

Nov. 29, 1976 [BE] Belgium ..... 645780

[51] Int. Cl.[2] ..... B65B 13/18

[52] U.S. Cl. ..... 100/7; 100/10; 53/582

[58] Field of Search ..... 100/7, 8, 10; 53/198 R

[56] References Cited

U.S. PATENT DOCUMENTS

| | | | |
|---|---|---|---|
| 1,417,329 | 5/1922 | Jones | 100/10 |
| 1,490,612 | 4/1924 | Laencher | 100/10 X |
| 2,066,971 | 1/1937 | Gora | 100/7 X |
| 2,847,810 | 8/1958 | Davey | 53/198 R |
| 2,972,294 | 2/1961 | Lecocq | 100/10 |
| 3,263,597 | 8/1966 | Stychinsky | 100/10 |

*Primary Examiner*—Billy J. Wilhite
*Attorney, Agent, or Firm*—Martin A. Farber

[57] ABSTRACT

There is disclosed an apparatus for manufacturing angle-section members and binding these members in bundles, in which the angle-section members, formed at a manufacturing station drop, apex upwards, onto supports carried by a conveyor to form a nested stack of the angle-section members on each support. The stacks thus formed are conveyed, on their supports, under binding devices at a bending station where each binding device bends a fastening element about the stack to form a bound bundle. Each bending device comprises a vertically slidable slide element having a bifurcated lower end defined by two downwardly extending arms the lower ends of which have pulleys around which a chain passes to extend between the arms, and upwardly from the pulleys, on the outsides of the arms, the chain being kept resiliently under tension. Each slide element has a fastening element in the form of a length of metal ribbon extending between the free ends of its arms, on the outer side of the chain and when the slide element is thrust over a stack of angle-section members to be bound, the length of ribbon is bent around the stack by the chain and the chain drawn around the stack into the gap between said arms from the outsides of the arms and bending devices attached to the chain pass around said pulley from positions outside said gap between said arms, to positions extending into said gap, the bending devices, in so passing, bending the ends of the fastening element into the downwardly presented valley of the lowermost angle-section member of the stack.

11 Claims, 3 Drawing Figures

DEVICE FOR BINDING BUNDLES OF ELONGATE ANGLE-SECTION MEMBERS AND MANUFACTURING APPARATUS INCORPORATING SUCH DEVICES

The invention relates to a device for binding bundles of elongate angle-section members, for example such as are used for protecting plaster corners in ceiling work.

At present, such protective angle-section members are bound in bundles by hand, which is labour-intensive and relatively slow. This slowness is a drawback, since such angle-section members are manufactured very rapidly by machine and the bundling operation cannot keep pace with rate of manufacture.

It is an object of the invention to provide a device by means of which bundles of elongate angle-section members can be readily bound, using bendable fastening elements of steel, aluminium or other appropriate material.

SUMMARY OF THE INVENTION

According to the invention there is provided a device for binding bundles of similar angle-section members so arranged that in each such bundle the ridges of the angle-section members all face in the same direction and each angle-section member is nested snugly within the next so that the ridge of one angle-section member is presented outwardly at one lateral boundary of the bundle and the valley of another angle-section member is presented outwardly at the opposite lateral boundary of the bundle, the device comprising an element having a bifurcated end, the element having two arms which form said bifurcated end, means for supporting a bendable fastening filament in a position extending between said two arms, and bending means for bending fastening filament ends, whereby said element can be thrust over a said bundle of angle-section members so that said arms of the element pass on either side of the bundle, with the ridges of the angle-section members facing towards the closed end of the gap between said two arms, and the fastening filament thereby bent around the said bundle, said end bending means being operable by approach of a said bundle beyond a predetermined extent toward the closed end of said gap to bend the ends of a said filament, so bent around said bundle, into the outwardly presented valley of the angle-section member of the bundle which is nearest said open end of said gap.

An automatic bundling and binding device constructed according to the invention will be described hereinafter in greater detail with reference to the accompanying drawings, which are given solely by way of example.

BRIEF DESCRIPTION OF THE DRAWINGS

In the drawings:

FIG. 1 shows a machine for manufacturing elongate angle-section members for protecting plaster corners in ceiling work.

Figure 1:
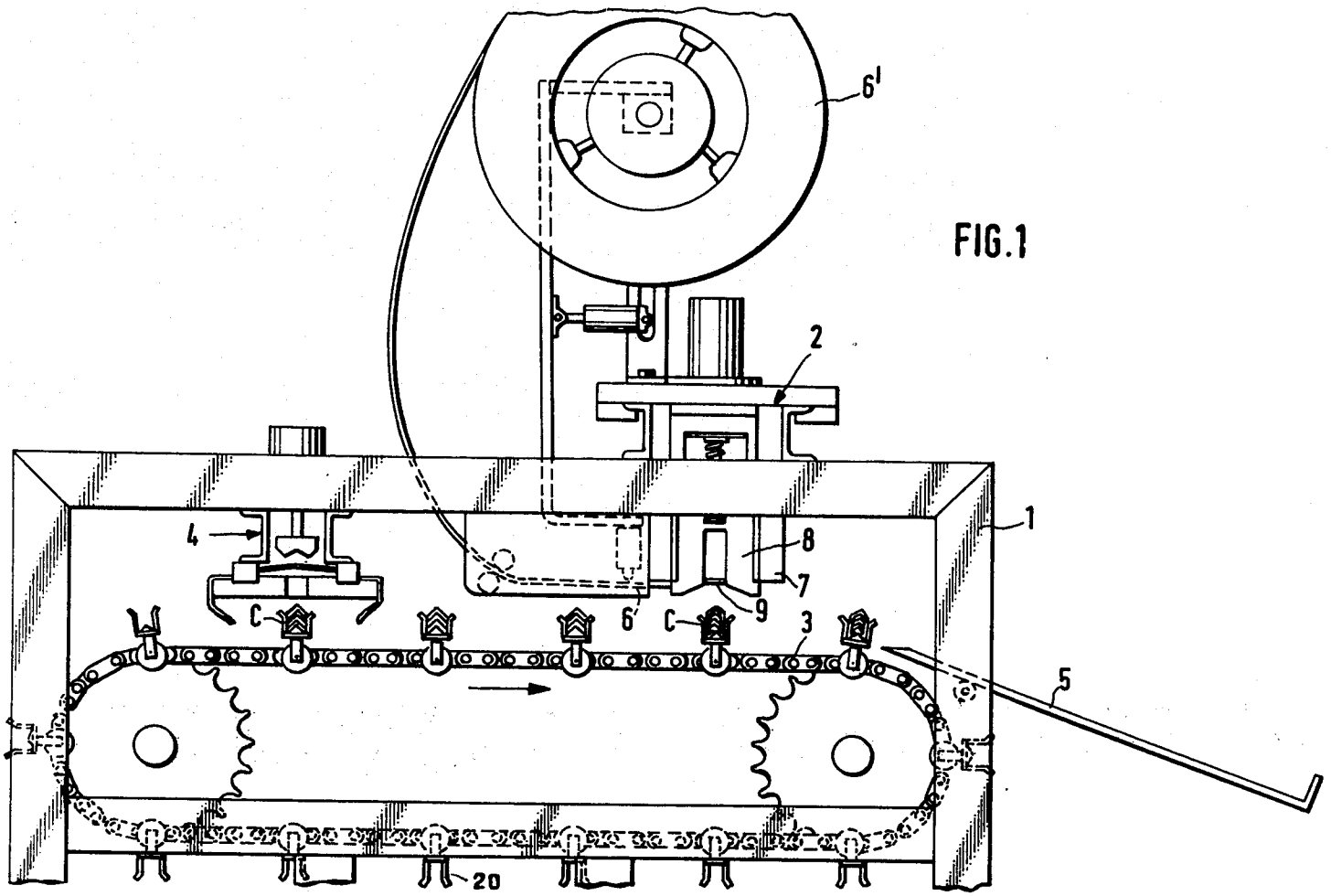
FIG. 1 is a side view of a machine for manufacturing angle-section members for protecting plaster corners in ceiling work, the machine comprising binding devices according to the invention.
Figure 2:
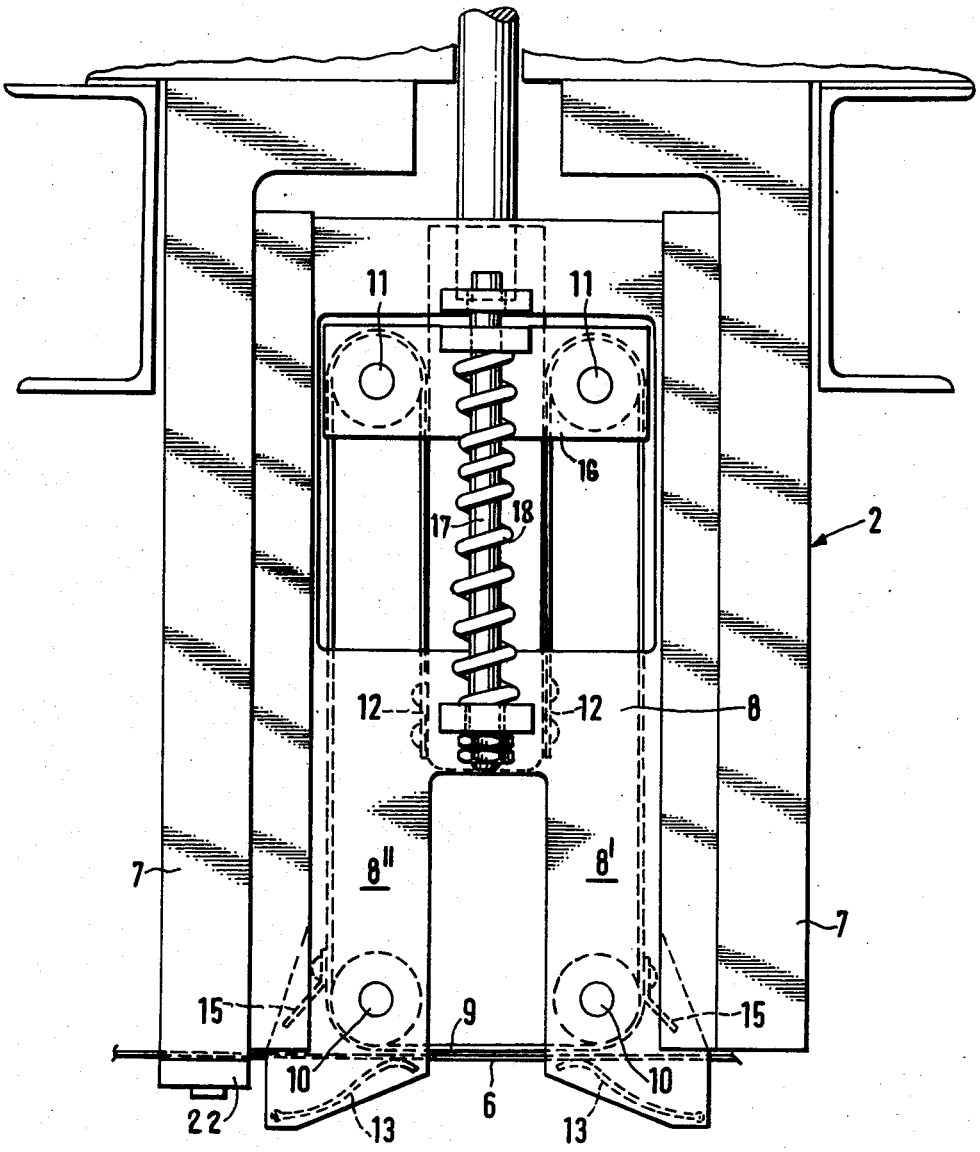
FIG. 2 is a partial side view, to an enlarged scale as compared with FIG. 1, showing a said binding device in a retracted position.

The machine shown in FIG. 1 comprises a longitudinal frame 1 on which a plurality of automatic binding devices 2 are mounted. Stack-supporting devices 20 are mounted on an endless conveyor 3 which conveys the angle-section members C stacked in the devices 20 from the outlet of a manufacturing station 4 to an inclined discharge plaen 5. Devices 2 are disposed in a binding station 1 above the region through which the devices 20 pass, carrying the angle members to be bundled and therefore operate in the downward direction. During conveyance, of course, the members C have their longitudinal axes horizontal and at right angles to the conveying direction.

The angle members are formed into stacks of, for example, ten in the devices 20 at the outlet of station 4, each angle-section member C being disposed with its ridge facing upwards and its valley corresponding to the ridge, facing downwards, each member C in a stack fitting snugly into the angle or valley of the member C immediately above in the stack. The stacks of members C are conveyed under the bundling devices 2. When a stack of members C has been moved into position under devices 2, the conveyor is stopped while the stack is bound, at places corresponding to the positions of devices 2, by respective lengths of metal ribbon element 6, each such length coming from a respective ribbon supply roll 6′ associated with the respective bundling device 2.

After being bound, the conveyor is started again and the stacks or bundles of angle-section are conveyed to a discharge position where they are discharged on the inclined plane 5.

Each automatic binding device comprises a support fixed to frame 1 and having vertical slidways 7 between and within which a slide element 8 can slide vertically. Element 8 is movable vertically either by a pneumatic or a hydraulic jack or mechanically. The slide element 8 has a bifurcated lower end provided by two downwardly extending arms 8′, 8″ between which a downwardly open gap is defined.

Rotatably mounted in the lower free end of each arm 8′, 8″ is a respective guide wheel 10, and an extensible means 9, in the form of a flexible belt or other filamentary, transversely flexible, tension transmitting element extends across the gap between the arms 8′, 8″ between the guide wheels 10, the extensible means 9 extending from the gap partly over each guide wheel 10 and upwardly from each guide wheel 10 to a respective second guide wheel 11, then passing around the respective guide wheels 11 and downwardly once more, the ends of the extensible means being secured, at respective attachment points 12, to the slide element 8. In the preferred embodiment, the means 9 is a flexible belt and the guide wheels 10, 11 are pulleys, but the means 9 may be a chain and the guide wheels 10, 11 sprockets, or simply pulleys or rollers. For convenience, means 9 is hereafter referred to as belt 9 and wheels 10 and 11 as pulleys.

The pulleys 11 are rotatably mounted in a cross-member 16, which is received in a rectangular aperture in slide element 8 and is vertically slidable on a vertical rod 17 fixed to slide 8 and urged upwardly with respect to slide 8 by a compression spring 18 engaged around rod 17 and serving to keep belt 9 in tension.

It will be appreciated that when the element 8 is moved downwards over a stack of angle-section members so that the stack enters the gap between arms 8′ and 8″, drawing the belt upwards, relative to the slide, in a loop into the gap between arms 8′, 8″, so that the length of the part of the belt between pulleys 10 is increased, there is a corresponding decrease in the length of the belt between each pulley 10 and the respective end of the belt so that the cross piece 16 and pulleys 11 are drawn towards the pulleys 10 against the action of spring 18.

Each of the two portions of the belt which, in the retracted position of the slide element 8, extend between a pulley 10 and the respective pulley 11 immediately above has secured thereto a respective finger 15 which projects at an angle downwardly and outwardly in a direction away from the gap between arms 8', 8''.

Spring 18 returns the belt to its starting position as the slide 8 is moved upwardly again away from the stack of angle-section members. Element 8 has a cutting blade 20 which, during the sliding motion of the slide 8, moves past a blade 22 secured to the stationary slideway 7 and by cooperation with the blade 22 cuts from the ribbon 6 the length which extends under belt 9 between the arms of the element 8. The blades 20, 22 thus together form ribbon shears. Spring-actuated lugs 13 are disposed in arms 8', 8'' for holding the severed portion of the ribbon in position.

Figure 3:
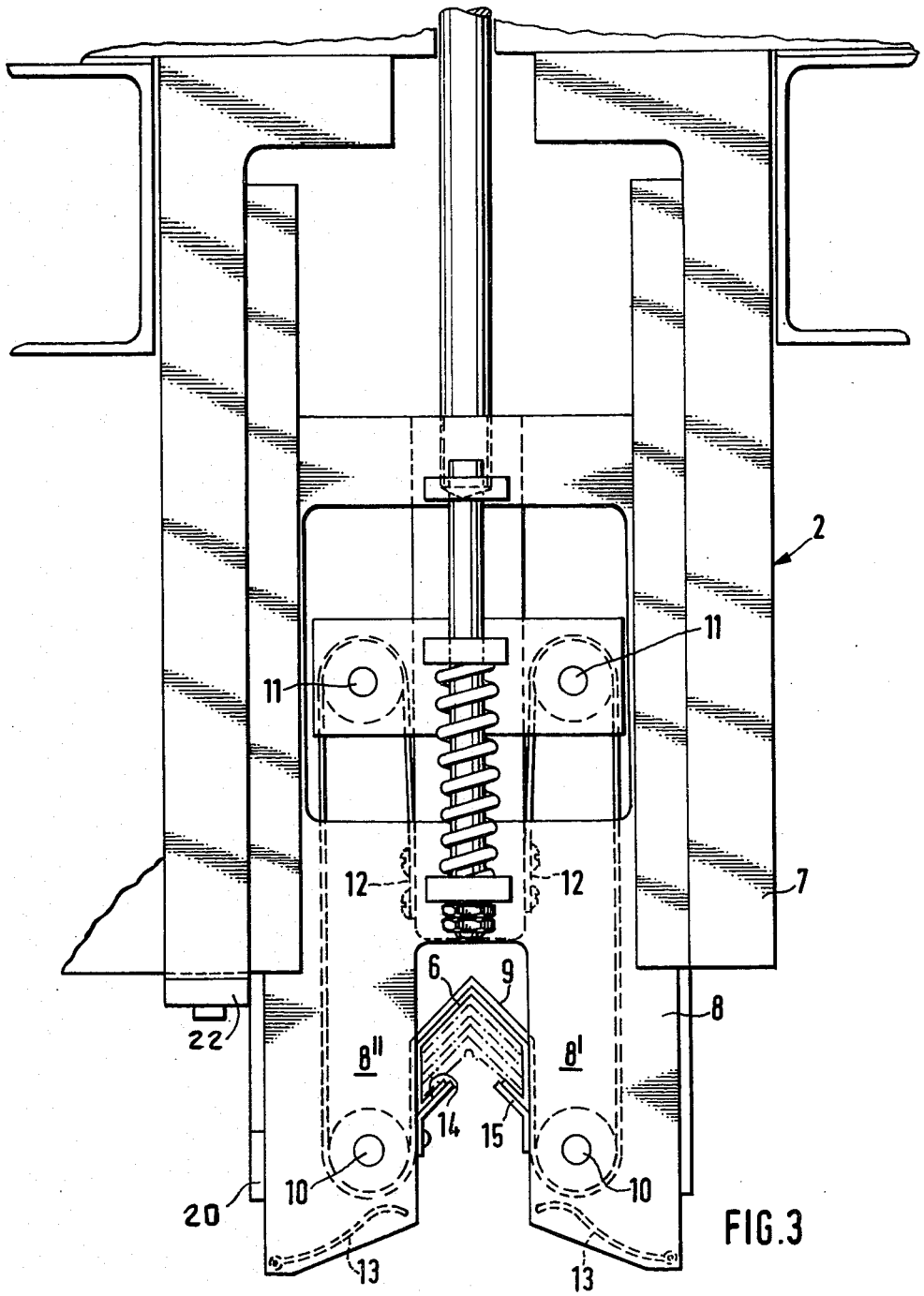
FIG. 3 is a view corresponding to FIG. 2, but showing the binding device in the extended position.

The operation of the aforementioned automatic binding device is very simple. A stack of protective angle members C manufactured in the preceding station 4 in the machine is conveyed by conveyor 3 under the devices 2, so that the stack is aligned vertically with the gap between the arms of the slide element 8 of each device 2. Next, each element 8 is slid downwards so that the severed portion of ribbon 6 and the belt 9 first come in contact with the ridge of the top angle member in the stack and then are bent around the stack to surround the sides of the stack. As each slide 8 is lowered still further, the fingers 15 move around respective rollers 10 to swing upwards and into the gap between arms 8' and 8'' and in doing so the fingers 15 engage the ends 14 of the severed portion of metal ribbon and bend these ends into the downwardly presented valley or angle of the lowermost angle-section member of the stack. This position is shown in FIG. 3. Fingers 15 can move around pulleys 10 in spite of lugs 13, since the latter are spring-mounted.

After the slide element 8 has reached its bottom end-of-travel position, the binding operation is complete, after which the slide element and belt are brought back to their starting positions. The bundle of protective angle-section members is conveyed by conveyor 3 to the inclined discharge plane 5. Next, a fresh stack of angle-section members is brought under the devices 2 and a ribbon feed mechanism, (not shown), associated with each device 2 feeds a further length of metal ribbon across the gap between arms 8' and 8''. The operation is then repeated.

The binding devices described have the advantage of being simple and being able to keep pace with the very rapid rate of manufacture of the machine which manufactures the angle-section members.

I claim:

1. A device for binding bundles of similar angle-section members so arranged that in each such bundle the ridges of the angle-section members all face in the same direction and each angle-section member is nested snugly within the next so that the ridge of one angle-section member is presented outwardly at one lateral boundary of the bundle and the valley of another angle-section member is presented outwardly at the opposite lateral boundary of the bundle, the device comprising an element having a bifurcated end, the element having two arms which form said bifurcated end, means for supporting a bendable fastening filament in a position extending between said two arms, and bending means for bending fastening filament ends, whereby said element can be thrust over a said bundle of angle-section members so that said arms of the element pass on either side of the bundle, with the ridges of the angle-section members facing towards the closed end of the gap between said two arms, and the fastening filament thereby bent around the said bundle, said end bending means being operable by approach of a said bundle beyond a predetermined extent toward the closed end of said gap to bend the ends of a said filament, so bent around said bundle, into the outwardly presented valley of the angle-section member of the bundle which is nearest said open end of said gap.

2. The device of claim 1 wherein said end-bending means comprises a member which, before thrusting of said element over a said bundle extends across the open end of said gap between said arms, on the side, nearer the closed end of said gap, of the position occupied by a said bendable filament before bending around a said bundle, means mounting said member for displacement relative to said bifurcated element by engagement with a said bundle during thrusting of the element over the bundle, said end bending means further comprising end-bending devices, and means operatively connecting said end-bending means with said member whereby on thrusting said member beyond a predetermined extent towards said closed end of said gap by thrusting the bifurcated element over a said bundle, said bending devices are caused to move inwardly from said arms and towards the closed end of said gap to engage the ends of the bendable fastening filament bent over the bundle and bend said ends into the outwardly presented valley at the respective lateral boundary of the bundle.

3. The device of claim 2 wherein said member, which, before thrusting of said element over a said bundle, extends across the open end of said gap, comprises a transversely flexible, tension-transmitting element, the device including tensioning means for tensioning said tension-transmitting element, a respective first guiding wheel for said transversely flexible element, means rotatably mounting each said first guiding wheel adjacent the free end of a respective one of said two arms, said transversely flexible element extending between said first guiding wheels and partly around each said guiding wheel and extending from each said first guiding wheel to said tensioning means, said tensioning means permitting movement of said transversely flexible element around said first guiding wheels into said gap under tension when said bifurcated element is thrust over a said bundle, said end-bending means being members secured to said chain at positions which, when said gap is unoccupied by a bundle to be bound, lie outside said gap.

4. The device of claim 1 including means for supporting a said bundle of angle-section members to be bound, a support for said bifurcated element, and means mounting said bifurcated element for sliding in said support towards and away from said means for supporting a said bundle, in a direction corresponding to the direction in which said arms extend.

5. A device for binding bundles of similar angle-section members so arranged that in each said bundle the ridges of the angle-section members all face in the same direction and each angle-section member is nested snugly within the next so that the ridge of one angle-section member is presented outwardly at one lateral boundary of the bundle and the valley of another angle-section member is presented outwardly at the opposite lateral boundary of the bundle, the device comprising a slide element having a bifurcated end, the slide element having two arms which provide said bifurcated end, a supporting means for supporting a said bundle with its longitudianl axis extending in a first predetermined direction, and with the ridges of the angle-section members in the bundle pointing in a second predetermined direction perpendicular to the first, a support for said slide element, spaced from said supporting means in said second predetermined direction, means mounting said slide element, so that the latter is disposed transversely of said first predetermined direction for sliding movement towards and away from said supporting means in a direction corresponding to that in which said arms extend, between an extended and a retracted position, whereby said slide element can be thrust over a said bundle supported by said supporting means so that said arms pass on opposite sides of said bundle, the device including an extensible means, means mounting the extensible means to extend across the open end of the gap defined between said two arms in the absence of a said bundle and for movement to a position in which, when the slide element is thrust over a said bundle supported by said supporting means, said extensible means extends around said bundle as far as the concave side thereof presented outwardly of said gap, the device further including means for supporting a supply of ribbon of bendable fastening material, means for supporting a portion of said ribbon to extend across said gap adjacent the free ends of said arms to lie on the side of said extensible means remote from the closed end of said gap, cutting means for severing said portion from said supply during sliding movement of said slide element towards said supporting means, the device further comprising bending devices for bending end parts of a said portion of said ribbon, into the outwardly presented valley of a said bundle, and means mounting said bending devices on said extensible means, whereby when said slide element is caused to slide to thrust the slide element over a said bundle supported by said supporting means, a said portion of said ribbon is cut to size, said portion, disposed between the bundle and said extensible means, being bent around the bundle, insertion of said bundle into said gap beyond a predetermined extent serving to act on said extensible means to cause said bending devices to bend the end parts of the severed said portion into the valley of the outwardly presented valley at one lateral boundary of the bundle.

6. The device of claim 5 in which said extensible means comprises a filamentary, transversely flexible, tension-transmitting element, the device further including two first guide wheels and two second guide wheels for said filamentary tension-transmitting element, second guide wheel carrying means, means mounting said second guide wheel carrying means at a location in said slide element remote from said bifurcated end thereof, for sliding movement, relative to said slide element, in a direction parallel with the direction of sliding movement of said slide element, means mounting each said second guide wheel rotatably on said second guide wheel carrying wheel carrying means, bias means urging said second guide wheel carrying means in the direction away from said bifurcated end, means mounting each said first guide wheel rotatably at the free end of a respective one of said arms of the slide element, means fixing the ends of said filamentary tension-transmitting with respect to said slide element, said filamentary tension-transmitting element extending from one end thereof around one said second guide wheel, around one said first guide wheel, across said gap between said arms, around the other said first guide wheel, then around the other said second guide wheel to the other end of said filamentary tension-transmitting element, whereby during entry of a said bundle into said gap of the slide element, and the consequent lengthening of the portion of the filamentary tension transmitting element which lies between the two said first guide wheels, the said second guide wheel carrying means is moved against said bias so that the distance between said second guide wheels and said first guide wheels decreases.

7. The device of claim 5, including, at the free end of each said arm of the slide element, a respective ribbon holding lug, a respective spring means acting on each said ribbon holding lug to urge the lug towards a ribbon holding position.

8. The device of claim 6, wherein said bending devices comprise two fingers, means mounting each said finger on the flexible tension-transmitting element at a respective said position which, when said flexible tension-transmitting element is extended straight between said first guide wheels, lies on the respective section of the flexible tension-transmitting element which extends between a respective said first guide wheel and the respective adjacent guide wheel, and which position, when said flexible tension transmitting element is drawn into said gap around a said bundle passing into said gap, travels around the respective said first guide wheel and into said gap.

9. The device of claim 5 wherein said cutting means comprises a cutting blade on said slide element and a cooperating cutting blade on said support for said slide element, said cutting blades together forming cutting shears, which make a cutting stroke during sliding of said slide element in the direction of its bifurcated end, relative to said support.

10. The device of claim 5 further in combination with a manufacturing station, a conveyer extending from said manufacturing station for conveying angle-section members from the manufacturing station, a binding station disposed adjacent said conveyor downstream of said manufacturing station for binding bundles of angle-section members and wherein a plurality of said binding devices are located.

11. The apparatus of claim 10 wherein said conveyor comprises a plurality of stack supporting devices for supporting, in a stack, a plurality of angle-section members deposited thereon at said manufacturing station, each said stack forming a bundle to be bound at said binding station, the apparatus further comprising a discharge point and said conveyor extending from said binding station to said discharge point whereby bundles of angle-section members, after binding at said binding station can be conveyed therefrom and discharged at said discharge point.

* * * * *